US005535803A

United States Patent [19]

Pretorius

[11] Patent Number: 5,535,803

[45] Date of Patent: Jul. 16, 1996

[54] EXPANDABLE SECURITY GRILLE OR BARRIER

[76] Inventor: Izak J. Pretorius, 26 Doncaster Street, Newmarket Small Holdings, Alberton, Transvaal Province, South Africa

[21] Appl. No.: 213,728

[22] Filed: Mar. 16, 1994

[30] Foreign Application Priority Data

Mar. 24, 1993 [ZA] South Africa ..... 93/2077

[51] Int. Cl.[6] ..... E06B 3/92

[52] U.S. Cl. ..... 160/136

[58] Field of Search ..... 160/136, 137, 160/138, 139, 140, 141, 142, 143, 144, 145, 146, 147, 148, 149, 150, 151, 152, 153, 154, 155, 156, 157, 158, 159, 160, 161, 162, 163, 164, 165

[56] References Cited

U.S. PATENT DOCUMENTS 583,235 5/1897 McCormick ..... 160/160 X 1,877,829 9/1932 Erlinder ..... 160/159 X 4,006,768 2/1977 Horgan ..... 160/136

4,816,310 3/1989 Truyens ..... 160/136 X

*Primary Examiner*—David M. Purol

*Attorney, Agent, or Firm*—Birch, Stewart, Kolasch & Birch

[57] ABSTRACT

A security grille is provided of the type in which a series of tubular uprights are interconnected by transverse link members so as to provide an expandable and contractible grille. The tubular uprights have slots for guiding and locating transverse studs at the free ends of the link members. The slots are defined by inserts which are plastic mouldings fitted into apertures cut in the wall of the tubular uprights. The fittings have closed inner ends and form a total closure to the aperture to prevent the ingress of dirt and moisture. The inserts also have peripheral flanges of a substantially convex outer shape to prevent fouling thereof by the link members.

12 Claims, 3 Drawing Sheets

EXPANDABLE SECURITY GRILLE OR BARRIER

FIELD OF THE INVENTION

The present invention relates to an expandable security grille or barrier, commonly termed "grille" herein, and, more particularly, to an expandable security grille of the type comprising a series of generally parallel uprights mutually interlinked by means of laterally extending trellis or link members, herein referred to as "link members".

Still more particularly the present invention relates to a security barrier of the type having uprights made of metal tube assemblies and is concerned with the inhibition of corrosion of the uprights and associated metal parts.

BACKGROUND TO THE INVENTION

Laterally expandable security grilles of the type having a series of parallel uprights interlinked by means of laterally inclined link members are often made with each upright being composed of two parallel, spaced metal tubes, fixed together at spaced positions up to the height thereof. The resultant space between the two tubes receives the lateral link members passing therethrough. The link members are pivotally attached, either at one of their ends, or in the middle thereof, to one composite upright. Their free ends are held captive relative to an adjacent composite upright by means of a transverse axle or stud member passing through the link members and extending into a slot in each of the inwardly directed faces of the two tubes defining the composite upright.

The slot serves both to hold the axle or stud member captive and to guide it for longitudinal movement along the slot as the uprights are moved towards or away from each other.

Security grilles of this type at the lower end of the market, may have slots simply cut in the metal which co-operate with the axle or stud member. More sophisticated security grilles have a plastic insert for receiving the axle or stud member. In such a case each insert is installed in a hole punched in the wall of the metal tube, and the insert has a surrounding flange adjacent the face of the metal tube. The slot defined by the insert defines surfaces against which the axle or stud can slide smoothly. The insert is open at its inner end.

The type of insert described above, which is generally made of a suitable injection moulded plastics material, such as polypropylene, operates generally effectively, apart from two disadvantages.

The first disadvantage is that, the slot being open at its inner end, allows the ingress of moisture and other corrosive airborne materials. The second disadvantage is that the surrounding flange is somewhat square in cross-section and can interfere with the rotation of the link members about their pivots as the composite uprights are moved towards each other to open the security grille.

It is the object of the present invention to provide inserts; composite uprights embodying the same, and security grilles including such composite uprights, wherein effective sealing of an insert is possible, and also, interference of movement of the link members by the flange of the insert is decreased or eliminated entirely.

SUMMARY OF THE INVENTION

In accordance with one aspect of the present invention there is provided an expandable security grille comprising a plurality of tubular uprights interlinked with laterally extending link members the free ends of which have transverse studs or axles projecting into slots formed in the uprights so as to be guided for movement along the slots as the uprights are moved towards or away from each other, and wherein each slot is defined by an insert installed in an aperture through the wall of the tubular upright and each insert is injection moulded from plastics material to provide a blind inner end which is closed so that the insert serves also as a closure to the aperture.

In accordance with another aspect of invention there is provided an insert for installation in an aperture in a tubular component, the insert being injection moulded from plastics material to define a slot for acting as a guide to a transverse stud or axle extending into same and wherein the slot has a blind inner end which is entirely closed so that the insert may serve as a closure to aperture.

Further features of the invention provide for the entrance to the slot to have a surrounding peripheral flange wherein the flange preferably has an outer surface which is convex in cross-section, and thin at its outer periphery; for the flange at the ends of the slot to be substantially semi-circular in elevation to conform with the usual indentation formed at the ends of a die-cut aperture for accommodating the insert in consequence of the die cutting operation; for the outer surface of the insert to have clipping formations spaced from the flange and adapted to engage behind the periphery of the aperture in a tubular upright in the operative position; for the insert to be moulded of a nylon material; and for a sealant material to be employed to seal between the periphery of the aperture in the tubular component and adjacent zones of the insert.

The invention also provides for the uprights of the grille to be composite uprights wherein each composite upright comprises two parallel spaced juxtaposed tubes secured together and wherein the tubes are provided with apertures directed towards each other at corresponding locations and each of which receives an insert so as to provide inwardly directed corresponding slots receiving oppositely directed portions of a transverse axle or stud carried at a free end of a link member.

In order that the invention may be more fully understood, one embodiment and application of the invention will now be described with reference to the accompanying drawings.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION WITH REFERENCE TO THE DRAWINGS

In this embodiment the present invention is applied to a laterally expandable security grille, generally indicated by numeral 1, composed of a series of parallel composite uprights 2 interlinked by transverse inclined link members 3.

Figure 1:
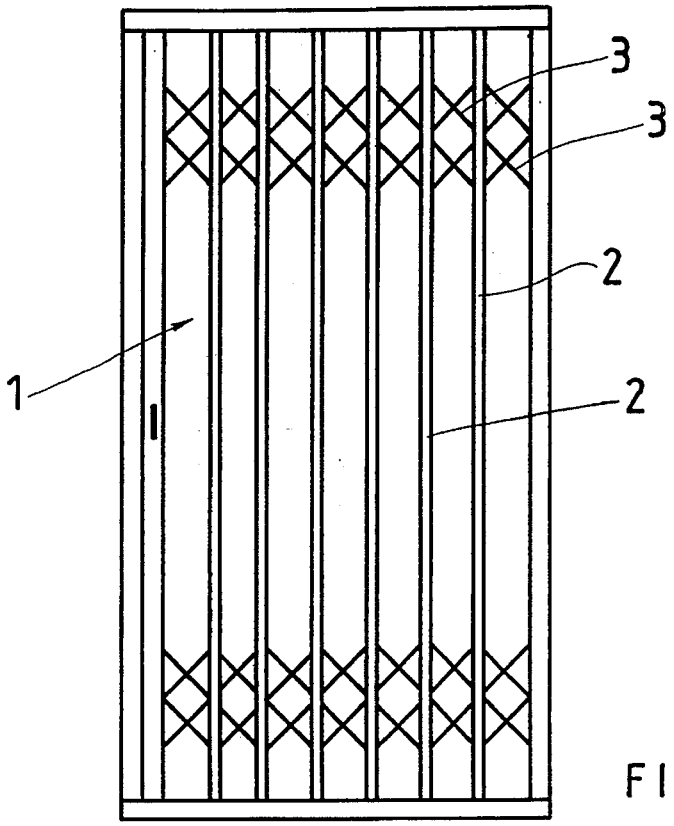
FIG. 1 is an elevation of an expandable security grille which may embody inserts according to the present invention.
Figure 2:
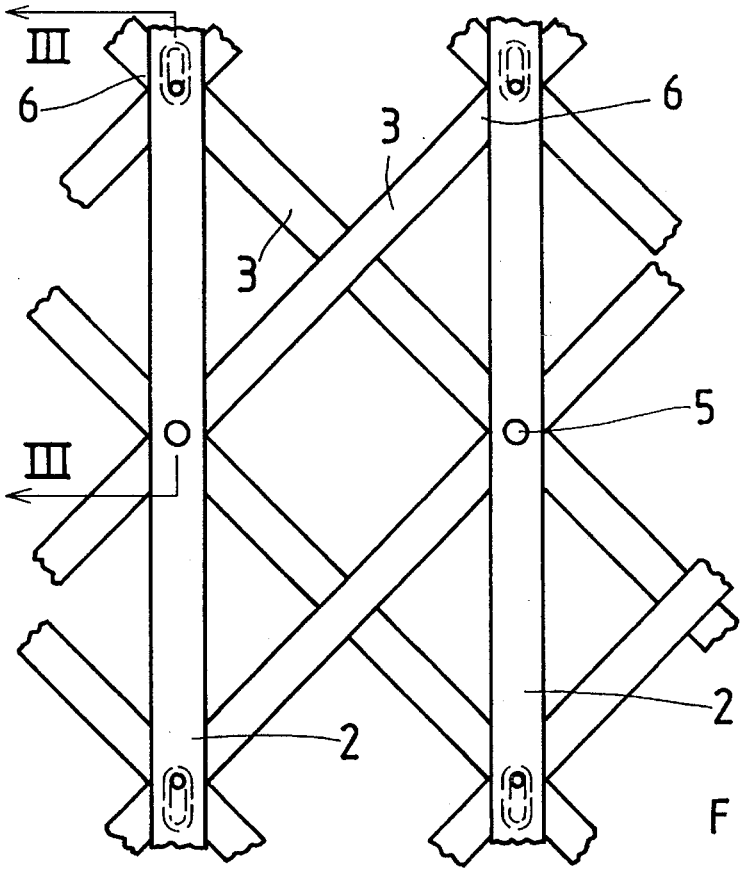
FIG. 2 is an enlarged view of a portion of the length of a pair of adjacent uprights where they are interlinked with link members.
Figure 3:
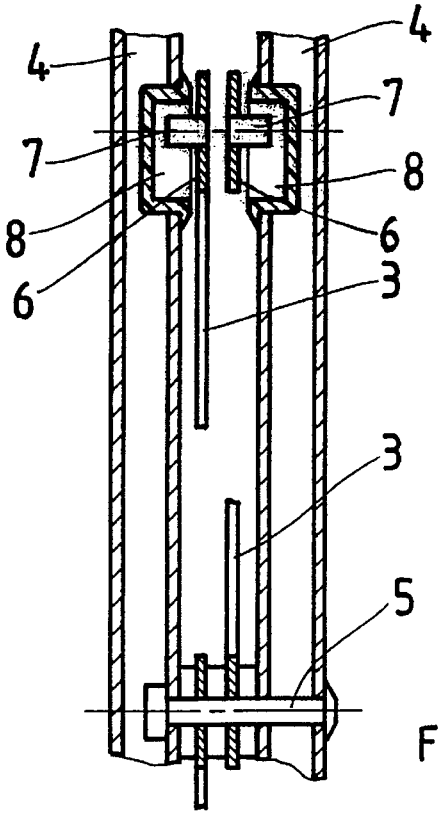
FIG. 3 is a sectional view taken along line III—III in FIG. 2.

Each of the composite uprights 2 is composed, as shown most clearly in FIG. 3, of a pair of spaced, square cross-sectioned tubular components 4 held in fixed spaced parallel juxtaposed relationship by a series of spacers and rivets spaced apart up to the height of the composite uprights. Some of the rivets, such as that indicated by numeral 5, serve as the pivots about which the link members rotate.

As is well known to those skilled in the art, the free ends 6 of the link members move effectively up and down relative to the composite uprights as the security grille is opened and closed respectively.

As shown in FIG. 3, the two ends 6 of the link members which diverge in opposite directions are interlinked by means of an axle member which has two oppositely directed studs 7 passing through holes in the end regions of the link members.

The studs 7 extend into inserts 8 having longitudinally extending slots 9 for guiding the movement of the studs and, therefore, the ends of the trellis members.

Figure 4:
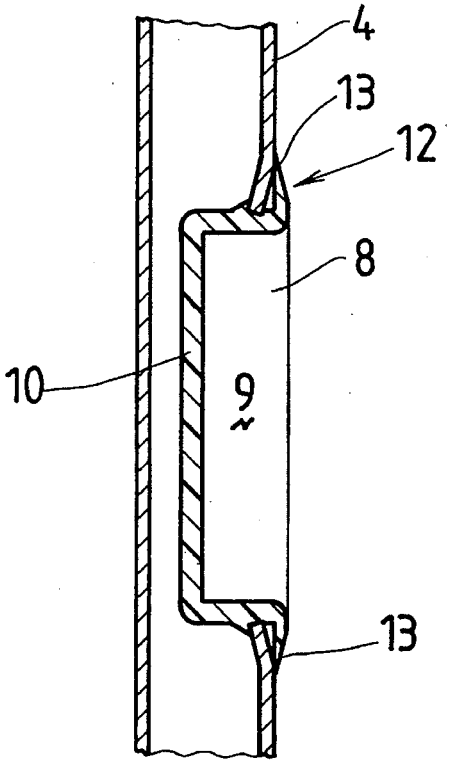
FIG. 4 is is a sectional elevation of a portion of a tubular component having an insert fitted therein.
Figure 5:
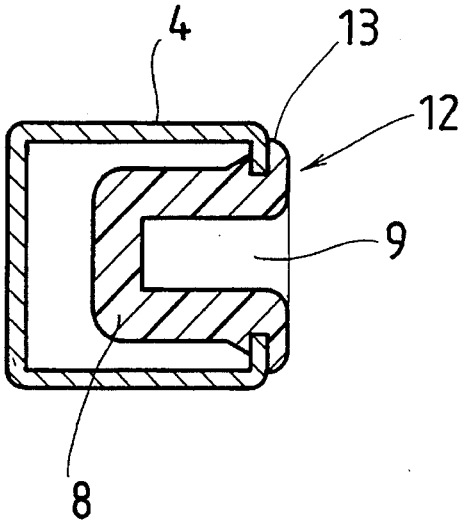
FIG. 5 is a cross-section through such a tubular component and insert fitted therein.
Figure 6:
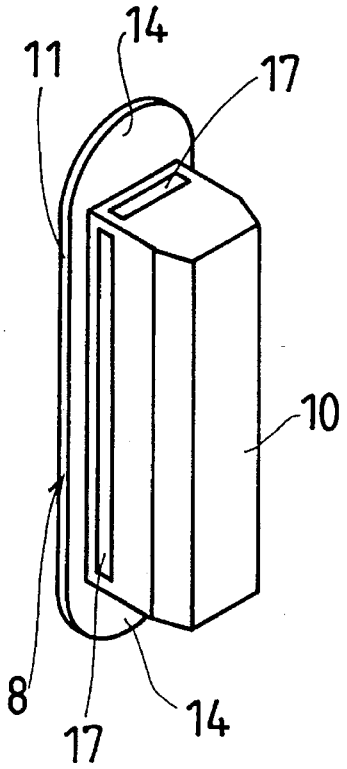
FIG. 6 is a rear isometric view of an insert alone.
Figure 7:
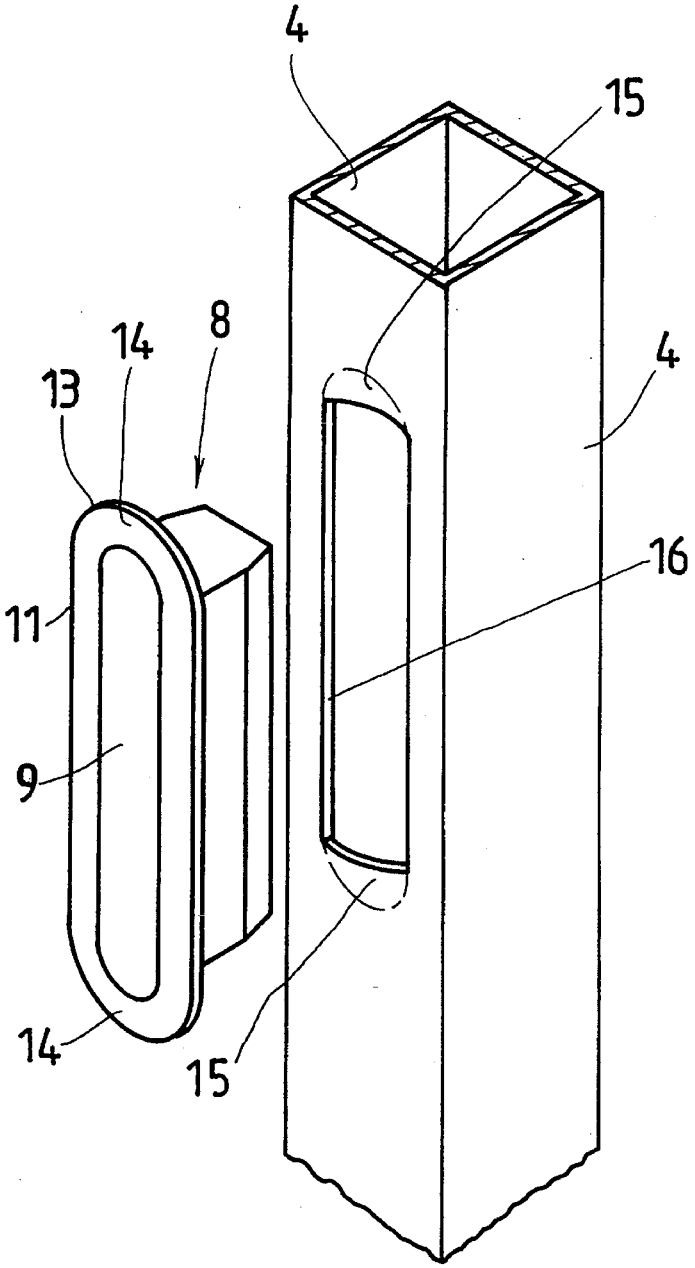
FIG. 7 is an isometric view from the front illustrating an insert in exploded relationship relative to its receiving aperture in a tubular component.

Referring now more particularly to FIGS. 4 to 7, the slot 9 extends along the length of the insert and in the operative orientation, extends longitudinally of the individual tubular component 4. The inserts are closed at the inner end of the slot, as indicated by numeral 10, and each has a peripheral flange 11 surrounding the edge of the slot. The flange, as shown most clearly in FIGS. 3 and 4, is convex in cross-section as indicated by numeral 12, so that the ultimate peripheral edge 13 is extremely thin.

In addition, the ends 14 of the flange are made to a semi-circular shape in elevation so that the peripheral edge will conform approximately to the commonly formed indentation 15 formed at each end of the slot 16 punched in the tubular component 4. This is most clearly shown in FIG. 7.

Furthermore, the inserts are provided with enlarged clipping formations 17 (see FIG. 6 in particular) spaced from the flange by a distance corresponding to the thickness of the wall of the tubular components. The arrangement is such that the clipping formations 17 engage behind the material around the mouth of the aperture in the tubular component to maintain the insert in its installed position.

During installation, a sealant is interposed between the periphery of the aperture and the corresponding region of the insert to permanently seal the insert relative to the component. A suitable sealant is that sold under the trade name TECTYL and composed of suitable waxes in an organic solvent.

It will be understood that an insert formed and installed as described above, and having a closed inner end to the slot, will form a complete closure to the aperture and the ingress of moisture or other corrosive airborne materials will be prevented.

It is to be noted that the ends of the tubular components are sealed with plugs and the holes used for rivets are similarly sealed, conveniently using plastics, washers or other sealant materials. A completely sealed tubular component and assembly thereof can therefore be formed using the present invention.

The convex cross-sectional configuration of the flange ensures that a link member rotating in the vicinity of the insert, and tending to foul against same, will simply ride up on top of the face of the flange as opposed to the prior art situation in which a rectangular cross-sectioned flange was provided and folding of the trellis members against the square edge of same was fairly commonplace.

It will be understood that numerous variations may be made to the embodiment of the invention described above without departing from the scope hereof. In particular, the configuration of the flange may be varied as may be required as can be the clipping formations which may, indeed, be omitted if the sealant acts as an adhesive to maintain the inserts in position in their associated aperture in the tubular component.

What I/we claim as new and desired to secure by Letters Patent is:

1. An expandable security grille comprising a plurality of tubular uprights, each of which has a wall with slots formed therein, said tubular uprights being interlinked with laterally extending link members, each of which has a pair of free ends, each provided with transverse studs or axles projecting into one of said slots formed in the uprights to be guided for movement along the slots as the uprights are moved towards or away from each other, and wherein each slot is defined by an insert located in an aperture disposed in the wall of the tubular upright and each insert is injection moulded from plastic material to provide a blind inner end which is closed so that each insert also serves as a closure to the aperture in which it is located.

2. The security grille of claim 1 wherein the insert is provided with a flange which engages the wall of the tubular upright adjacent the slot.

3. The security grille of claim 2 wherein an outer surface of the flange is convex in cross-section and an outer edge of the flange is relatively thin.

4. The security grille of claim 2 wherein the flange has end portions which are substantially semi-circular in elevation.

5. The security grille of claim 2 wherein each insert has clipping formations spaced from the flange for engagement behind the aperture in the tubular component.

6. The security grille of claim 1 wherein a sealant material is employed to provide a seal between the periphery of the aperture in the tubular component and adjacent zones of the insert.

7. The security grille of claim 1 wherein each upright is a composite upright comprising two, parallel spaced, juxtaposed tubes secured together and wherein the tubes are provided with apertures directed towards each other at corresponding locations along said tubes and each of said apertures receives an insert so as to provide inwardly directed corresponding slots for receiving oppositely directed portions of a transverse axle or stud carried at a free end of a link member.

8. The security grille of claim 7 wherein the tubes are spaced apart by means of spacers located on rivets securing the tubes together.

9. An insert for installation in the aperture of the tubular component of claim 1, the insert being injection moulded from plastics material to define a slot for acting as a guide to a transverse stud or axle extending into same and wherein the slot has a blind inner end which is thus entirely closed so that the insert may serve as a closure to such an aperture.

10. An expandable security grille comprising a plurality of opposing pairs of tubular uprights, each of said pairs of uprights having a wall provided with opposing slots formed therein, said pairs of tubular uprights being interlinked with laterally extending link members, each of which having a pair of free ends provided with transverse studs or axles projecting into said opposing slots formed in the tubular uprights to be guided for movement along the slots as the uprights are moved towards or away from each other, and wherein each slot is defined by an insert provided in an aperture disposed in the wall of the tubular upright, each insert being injection moulded from plastic material to provide a blind inner end which is closed so that each insert also serves as a closure to the aperture in which it is located.

11. An insert for installation in an aperture provided in a tubular component of a security grille, said insert having a closed inner end, an open end which defines a slot and a configuration which corresponds to and is adapted to extend into said aperture, said insert provided with a peripheral flange having semi-circular peripheral edges and which is also convex in cross-section for engagement with the tubular component.

12. The insert of claim 11 wherein clip members are provided on said insert where it extends into said tubular component for holding the insert to the tubular component within said aperture.

* * * * *